US012624549B2

(12) United States Patent
Buley et al.

(10) Patent No.: US 12,624,549 B2
(45) Date of Patent: May 12, 2026

(54) REINFORCING BAR CAGE CONNECTORS AND METHODS OF CONSTRUCTING REINFORCING BAR CAGES

(71) Applicants: Gloria M. Buley, Whitewater, WI (US); Travis C. Buley, Whitewater, WI (US)

(72) Inventors: Gloria M. Buley, Whitewater, WI (US); Travis C. Buley, Whitewater, WI (US)

( * ) Notice: Subject to any disclaimer, the term of this patent is extended or adjusted under 35 U.S.C. 154(b) by 513 days.

(21) Appl. No.: 18/105,323

(22) Filed: Feb. 3, 2023

(65) Prior Publication Data

US 2024/0263452 A1 Aug. 8, 2024

(51) Int. Cl.

| | |
|---|---|
| ***E04C 5/16*** | (2006.01) |
| ***B21F 15/04*** | (2006.01) |
| ***E04C 5/06*** | (2006.01) |

(52) U.S. Cl.

CPC ..... *E04C 5/167* (2013.01); *B21F 15/04* (2013.01); *E04C 5/0604* (2013.01)

(58) Field of Classification Search

CPC .... E04C 5/0604; E04C 5/0609; E04C 5/0618; E04C 5/0622; E04C 5/0613; E04C 5/166; E04C 5/167; E04C 5/16; E04C 5/162; E04C 5/0627; E04C 5/201; B21F 15/04

USPC ..... 52/686, 687, 688

See application file for complete search history.

(56) References Cited

U.S. PATENT DOCUMENTS 828,931 A * 8/1906 Cummings ..... E04C 5/0618 52/649.4
918,715 A * 4/1909 Wedmore ..... E04C 5/0618 52/646
919,099 A * 4/1909 Wedmore ..... E04C 5/167 52/685
919,100 A * 4/1909 Wedmore ..... E04C 5/16 52/646
977,704 A * 12/1910 Brownlee ..... E04C 5/167 24/457
1,014,711 A * 1/1912 Lindau ..... E04C 5/0618 52/649.4
1,099,679 A * 6/1914 Wedmore ..... E04C 5/168 52/685

(Continued)

FOREIGN PATENT DOCUMENTS

KR 102152330 B1 * 9/2020 ..... E04B 1/642
WO 0045008 8/2000

*Primary Examiner* — James M Ference

(74) *Attorney, Agent, or Firm* — McAndrews, Held & Malloy, Ltd.

(57) ABSTRACT

Reinforcing bar cage connectors and methods of constructing reinforcing bar cages are provided. A reinforcing bar cage includes a reinforcing bar guide, a reinforcing bar rod, and a reinforcing bar cage connector. The reinforcing bar cage connector includes a first clamp portion facing a first direction and configured to receive one of the reinforcing bar guide or the reinforcing bar rod in a first opening. The reinforcing bar cage connector includes a second clamp portion facing a second direction, opposite the first direction, and configured to receive an other one of the reinforcing bar guide or the reinforcing bar rod in a second opening. The first opening is perpendicular to the second opening. The reinforcing bar cage connector includes a metal tie wire is operable to be twisted to compress the first clamp portion and the second clamp portion.

20 Claims, 9 Drawing Sheets

(56) References Cited

U.S. PATENT DOCUMENTS 1,119,123 A * 12/1914 Schoenthaler ..... E04C 5/168 52/686
1,124,536 A * 1/1915 Schoenthaler ..... E04C 5/168 52/685
1,143,323 A * 6/1915 Schoenthaler ..... E04C 5/168 52/685
1,274,687 A * 8/1918 Collings ..... E04C 5/0618 52/649.5
1,306,129 A * 6/1919 Stewart ..... E04C 5/168 52/719
1,362,188 A * 12/1920 Richardson ..... E04C 5/16 52/649.4
1,409,217 A * 3/1922 Kardong ..... E04C 5/16 52/649.4
1,409,645 A * 3/1922 Baker ..... E04C 5/0618 52/684
1,434,352 A * 10/1922 Ramsay ..... E04C 5/167 403/395
1,440,127 A * 12/1922 Barton ..... E04C 5/167 52/686
1,492,756 A * 5/1924 Shepherd ..... E04C 5/0618 52/649.5
1,492,757 A * 5/1924 Shepherd ..... E04C 5/16 52/649.4
1,496,178 A * 6/1924 Shepherd ..... E04C 5/16 52/649.4
1,500,832 A * 7/1924 Ludwik ..... E04C 5/167 52/719
1,507,755 A * 9/1924 Pinger ..... E04C 5/0618 52/649.8
1,567,211 A * 12/1925 Tubbs ..... E04C 5/167 52/685
1,684,051 A * 9/1928 Anderson ..... E04C 5/167 52/719
1,684,195 A * 9/1928 Olmsted ..... E04C 5/167 52/685
1,772,653 A * 8/1930 White ..... E04C 5/167 52/685
2,216,886 A * 10/1940 Langelier ..... B01L 9/50 126/30
2,300,027 A * 10/1942 Wilcox ..... E04C 5/166 52/685
3,367,084 A * 2/1968 Reiland ..... E04C 5/16 52/649.3
4,377,928 A * 3/1983 Hasak ..... E04C 5/0618 52/649.4
4,401,479 A * 8/1983 Quick ..... C23C 8/14 148/287
4,409,764 A * 10/1983 Wilnau ..... E04B 1/165 52/204.2
4,463,538 A * 8/1984 Dragunas ..... E04C 5/167 52/687
4,900,184 A * 2/1990 Cleveland ..... E04C 5/168 24/339
5,371,991 A * 12/1994 Bechtel ..... E04C 5/20 24/339
5,878,546 A * 3/1999 Westover ..... E04C 5/167 24/336
5,893,252 A * 4/1999 Hardy, Jr ..... E04C 5/168 52/685
6,161,360 A * 12/2000 Smith ..... E04C 5/168 52/165
6,354,054 B1 * 3/2002 Verelli ..... E04C 5/168 248/440
6,898,915 B2 * 5/2005 Hancock ..... E04C 5/167 52/687
7,143,563 B1 * 12/2006 Palmer ..... E04C 5/18 52/712
8,112,964 B2 * 2/2012 Baruh ..... E04C 5/167 52/712
11,098,488 B2 * 8/2021 Toyoda ..... E04C 5/167
11,319,707 B1 * 5/2022 Ayres ..... E04C 5/167
2002/0104286 A1 8/2002 Gregel et al.
2004/0088942 A1 * 5/2004 Trangsrud ..... E04C 5/20 52/655.1
2008/0072414 A1 * 3/2008 Buley ..... E04C 5/0604 29/527.1
2010/0043337 A1 * 2/2010 Banks ..... E04C 5/208 52/649.8
2011/0162317 A1 * 7/2011 Baruh ..... E04C 5/167 52/719
2017/0254085 A1 * 9/2017 Larkin ..... E04C 5/18
2018/0171635 A1 * 6/2018 Render ..... E04C 5/166
2018/0266110 A1 * 9/2018 Munsell ..... E04C 5/163
2020/0224418 A1 * 7/2020 Toyoda ..... E04C 5/18
2020/0248454 A1 * 8/2020 Park ..... E04C 5/0604
2022/0333382 A1 * 10/2022 Hanje ..... E04C 5/167
2024/0263452 A1 * 8/2024 Buley ..... E04C 5/167
2025/0075500 A1 * 3/2025 Buley ..... E04C 5/167

* cited by examiner

REINFORCING BAR CAGE CONNECTORS AND METHODS OF CONSTRUCTING REINFORCING BAR CAGES

FIELD

The present disclosure relates to fabrication of concrete elements that include reinforcing bar cages. More specifically, the present disclosure relates to reinforcing bar cage connectors operable to secure reinforcing bar cages used in fabrication of concrete elements, and methods of constructing reinforcing bar cages used in fabrication of concrete elements.

BACKGROUND

Concrete is a building material made from the combination of aggregate and a cement binder. A common form of concrete consists of Portland cement, mineral aggregates (for example, gravel and sand) and water. After mixing, the water reacts with the cement in a chemical process known as hydration, during which the water is absorbed by the cement, which hardens, binding the aggregates together and eventually creating a stone-like material. Concrete is used, for example, in pavement, building structures, foundations, roads, and bases for gates, fences and poles. Concrete is also used, for example, in concrete columns used in construction known as footings.

Concrete has high compressive strength, but low tensile strength. In other words, concrete can withstand axially directed pushing forces, but cannot withstand axially directed pulling forces. As a result, concrete elements subjected to tensile stresses are often reinforced with steel bars, known as reinforcing bar or rebar, which can aid in carrying tensile loads. Rebar is often formed from mild steel, and given ridges for better frictional adhesion to the concrete.

In practice, a reinforcing cage can be constructed out of rebar. A reinforcing cage can be constructed out of multiple pieces of rebar that are maintained relative to each other in conjunction with specific design requirements. Some examples of items that can influence the design requirements of a reinforcing cage include: the type of structure that is being fabricated, the size and weight of the structure, and the bearing capacity of the soil upon which the structure will rest.

Once a reinforcing cage is constructed, it can be inserted into a mold that can receive concrete. In one example, a mold can be a tube made of cardboard or other fibrous material. Examples of such tubes are the Sonotube® made by Sonoco Products Company and the Quik-Tube® made by the QUIKRETE® Companies.

Once a reinforcing cage is constructed and inserted into a mold, mixed concrete can be poured into the tube and allowed to harden. The result is a concrete element that includes a reinforcing cage that, as described above, can aid in carrying tensile loads.

Unfortunately, constructing a reinforcing cage can be time-consuming and cumbersome. For example, one method used to construct reinforcing cages utilizes pieces of wire to connect pieces of rebar in a desired configuration. However, one problem with such a method is that the resulting reinforcing cage is not very durable and can fall apart or lose desired dimensions when being moved or inserted into a mold. In another example, pieces of rebar that make up a reinforcing guide can be welded together. Such reinforcing guides are more durable than the ones held together by wires, however, they can be costly in terms of materials and labor.

Further limitations and disadvantages of conventional and traditional approaches will become apparent to one of skill in the art, through comparison of such systems with some aspects of the present disclosure as set forth in the remainder of the present application.

SUMMARY

Certain embodiments of the present technology provide reinforcing bar cage connectors and methods of constructing reinforcing bar cages, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
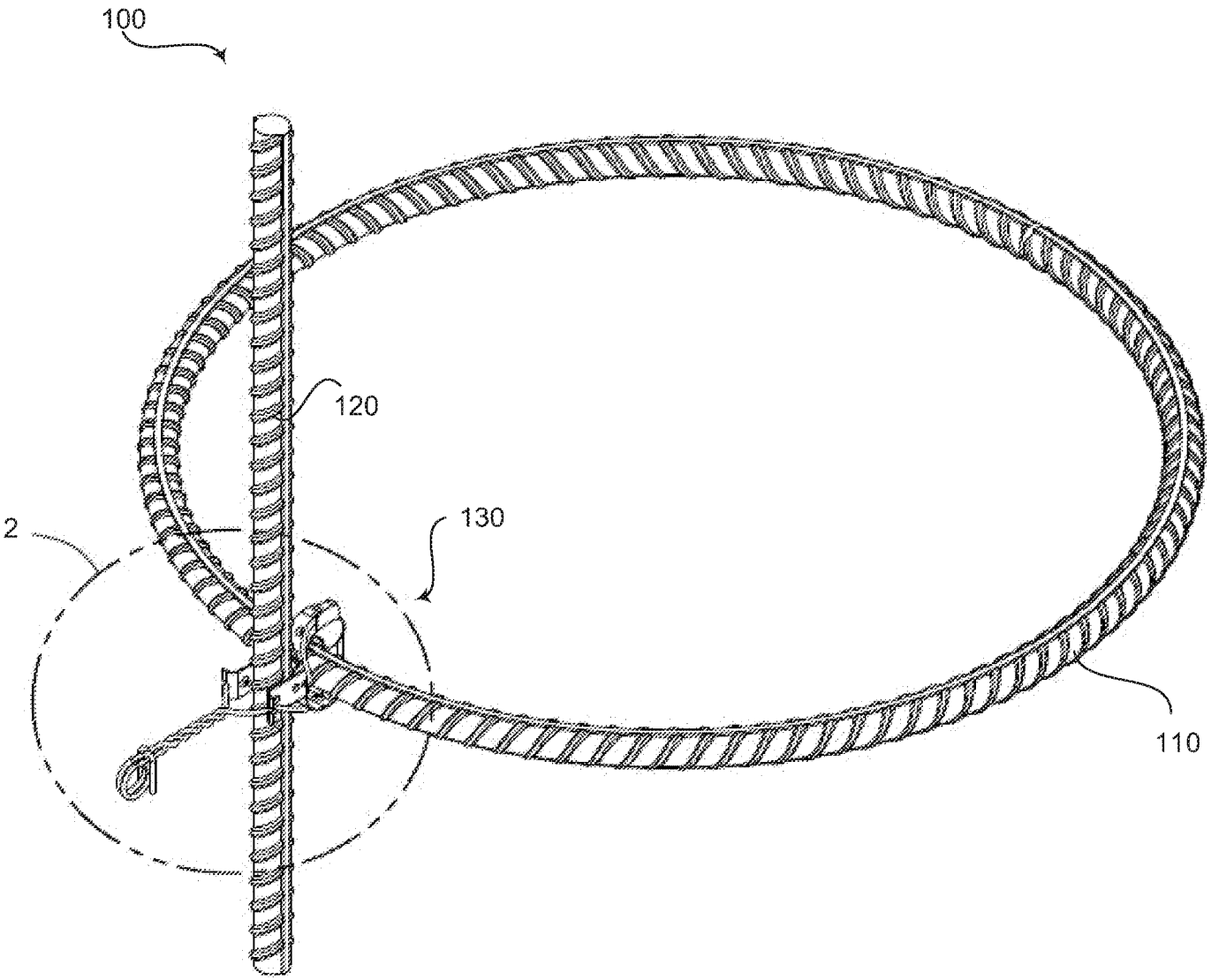
FIG. 1 depicts a front, top perspective view of an exemplary reinforcing bar cage having a reinforcing bar guide securely coupled to a reinforcing bar rod by a reinforcing bar cage connector, in accordance with various embodiments.

Embodiments of the present technology provide reinforcing bar cage connectors that quickly and securely fasten reinforcing bar guides to reinforcing bar rods to construct a reinforcing bar cage.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural changes may be made without departing from the scope of the various embodiments of the present disclosure. The following detailed description is, therefore, not to be taken in a limiting sense.

As used herein, an element or step recited in the singular and proceeded with the word "a" or "an" should be understood as not excluding the plural of the elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Figure 2:
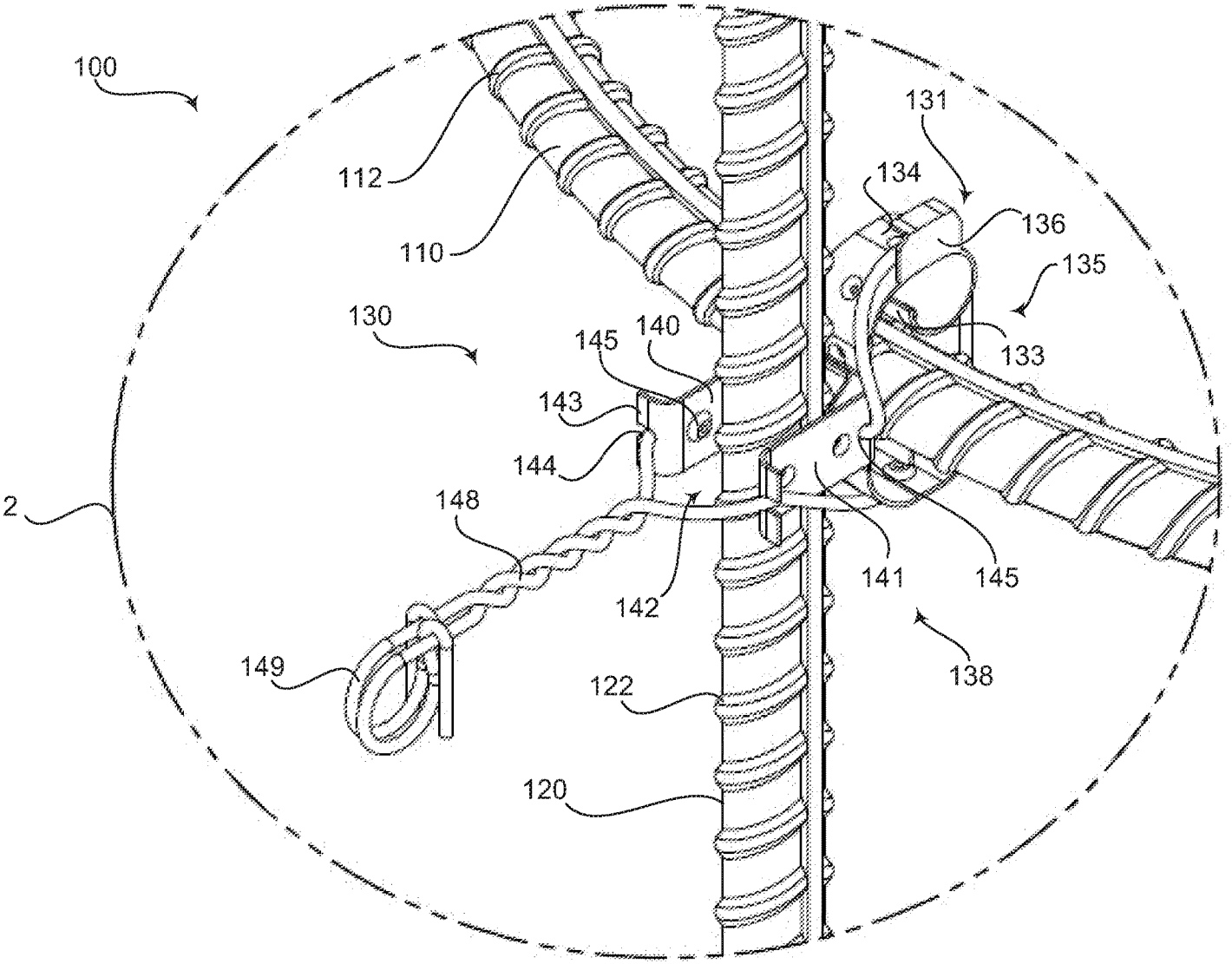
FIG. 2 depicts an enlarged view of the identified portion of FIG. 1, in accordance with various embodiments.
Figure 3:
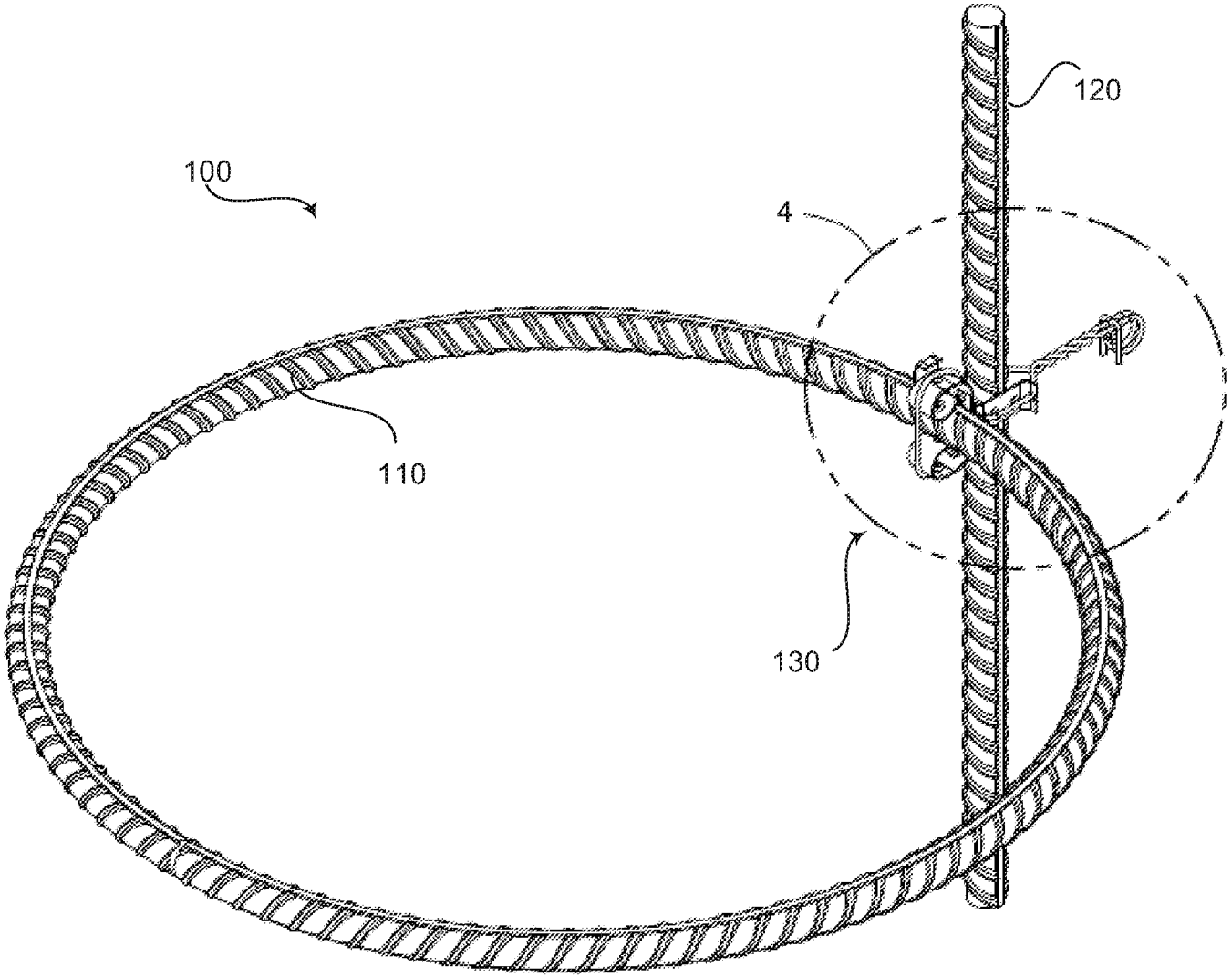
FIG. 3 depicts a rear, top perspective view of an exemplary reinforcing bar cage having a reinforcing bar guide securely coupled to a reinforcing bar rod by a reinforcing bar cage connector, in accordance with various embodiments.
Figure 4:
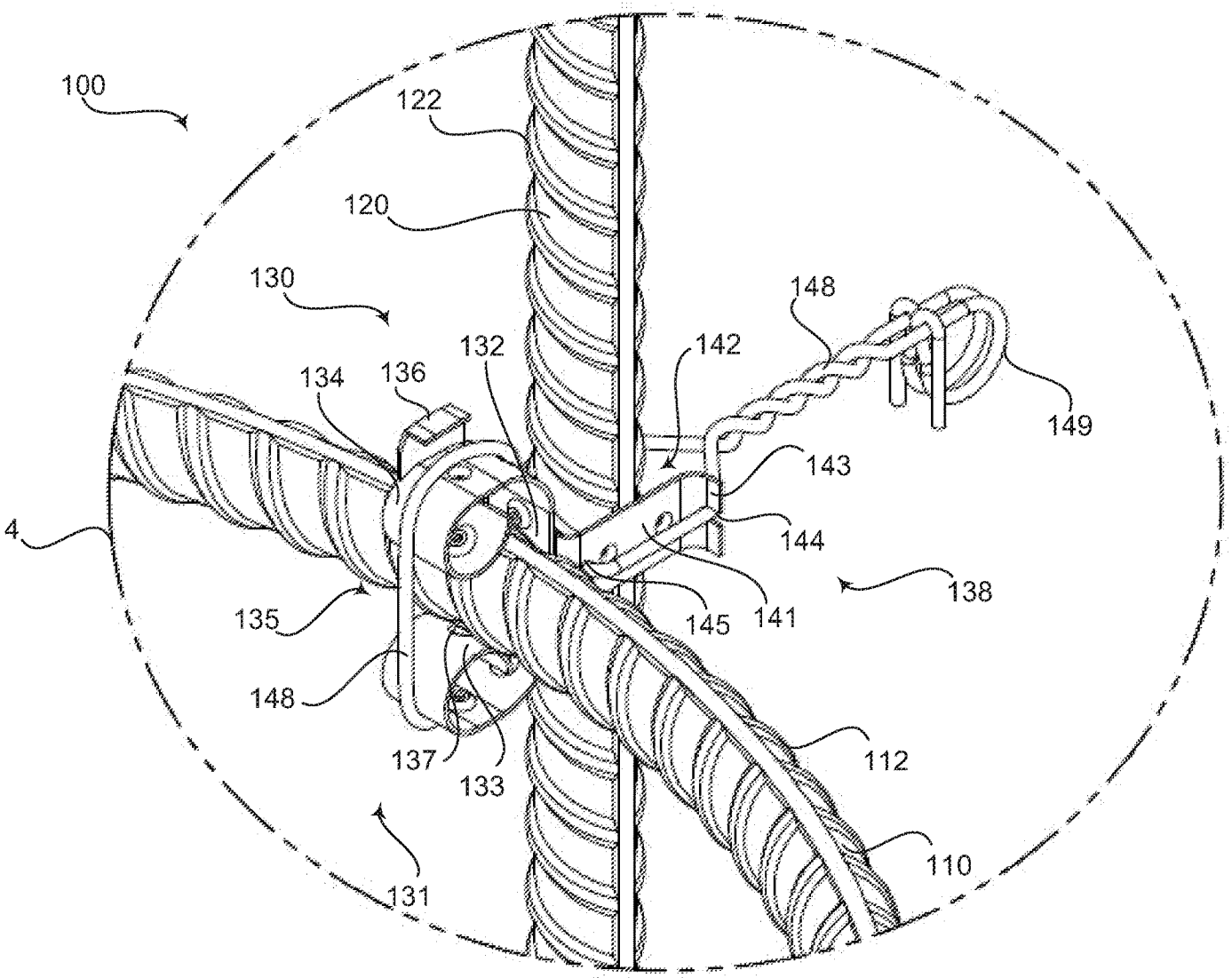
FIG. 4 depicts an enlarged view of the identified portion of FIG. 3, in accordance with various embodiments.

FIG. 1 depicts a front, top perspective view of an exemplary reinforcing bar cage 100 having a reinforcing bar guide 110 securely coupled to a reinforcing bar rod 120 by a reinforcing bar cage connector 130, in accordance with various embodiments. FIG. 2 depicts an enlarged view of the identified portion 2 of FIG. 1, in accordance with various embodiments. FIG. 3 depicts a rear, top perspective view of an exemplary reinforcing bar cage 100 having a reinforcing bar guide 110 securely coupled to a reinforcing bar rod 120 by a reinforcing bar cage connector 130, in accordance with various embodiments. FIG. 4 depicts an enlarged view of the identified portion 4 of FIG. 3, in accordance with various embodiments.

Referring to FIGS. 1-4, a reinforcing bar cage 100 is shown. The reinforcing bar cage 100 comprises a reinforcing bar guide 110, a reinforcing bar rod 120, and a reinforcing bar cage connector 130 securely fastening the reinforcing bar guide 110 to the reinforcing bar rod 120. As used herein, the term "reinforcing bar" is also referred to as "rebar" (e.g., rebar cage 100, rebar guide 110, rebar rod 120, rebar cage connector 130, and the like). Although the rebar cage 100 is shown having one rebar rod 120 attached to the rebar guide 110 by the rebar cage connector 130, any suitable number of rebar rods 120 may be fastened to rebar guide 110 by a corresponding number of rebar cage connectors 130. The rebar rods 120 may be evenly spaced or unevenly spaced around the rebar guide 110. Furthermore, any suitable number of rebar guides 110 may be secured to each rebar rod 120 by a corresponding number of rebar cage connectors 130. The rebar guides 110 may be evenly spaced or unevenly spaced along one or more of the rebar rods 120. For example, three (3) rebar guides 110 may be secured to four (4) rebar rods 120 using twelve (12) rebar cage connectors 130 to construct the rebar cage 100. As another example, five (5) rebar guides 110 may be secured to three (3) rebar rods 120 using fifteen (15) rebar cage connectors 130 to construct the rebar cage 100.

Although the rebar rod 120 is shown connected on an outside of the rebar guide 110, in various embodiments, the rebar rod 120 may additionally or alternatively be coupled to an inside of the rebar guide 110. Although the rebar guide 110 is illustrated as having an oval shape, in various embodiments, the rebar guide 110 may be any suitable shape, such as circular, square, triangular, rectangular, trapezoidal, or the like. For example, in other embodiments, the rebar guide 110 can be a straight element or an element with any number of bends or curves. As an example, in other embodiments, the shape of the rebar guide 110 can vary depending on the design requirements of the rebar guide 110. Although the rebar guide 110 and rebar rod 120 are both preferably made of rebar (i.e., reinforcing bar), in other embodiments, one or both of the rebar guide 110 and rebar rod 120 may not be made of rebar. For example, the rebar guide 110 and/or rebar rod 120 may be made of any strong and durable material. In various embodiments, the rebar cage connector 130 may be made of high carbon steel and/or any suitable material. In an exemplary embodiment, the rebar cage connector 130 may be coated with a rust-resistant material to increase durability and lifespan.

Still referring to FIGS. 1-4, the rebar cage 100 is constructed by securing the rebar guide 110 to the rebar rod 120 via the rebar cage connector 130. The rebar cage connector 130 comprises a first clamp portion 131 and a second clamp portion 138. The first clamp portion 131 comprises a base 132, sides 133, 134, an opening 135, an alignment tab 136, and punch grips 137. The sides 133, 134 extend from the base 132 and comprise inward facing side surfaces 133 and outward facing side surfaces 134. In various embodiments, the sides 133, 134 may curl inwards to provide the inward facing side surfaces 133. The opening 135 is defined between the inward facing side surfaces 133. The inward facing side surfaces 133 and base 132 may comprise punch grips 137. The punch grips 137 are protrusions (e.g., dimples, indents, or the like) configured to engage a deformation pattern 112, 122 on the rebar guide 110 or rebar rod 120 to provide a strong and stable connection. The deformation pattern 112, 122 is protrusions (e.g., ribs or the like) on the rebar 110, 120, which may be a helical pattern, V-shaped pattern, swirls, or any suitable pattern. The first clamp portion 131 is configured to receive the rebar guide 110 (as shown in FIGS. 1-4) or rebar rod 120 in the opening 135 and against the base 132 and inward facing side surfaces 133 having the punch grips 137. The outward facing side surfaces 134 may comprise an alignment tab 136 configured to guide a metal tie wire 148 along the outward facing side surfaces 134. The metal tie wire 148 wraps around the outward facing side surfaces 134 of the first clamp portion 131 and provides a compressive force via the sides 133, 134 on the rebar guide 110 or rod 120 within the opening 135 when the metal tie wire 148 is tightened.

The second clamp portion 138 comprises a base 139, sides 140, 141, an opening 142, and punch grips 147. The sides 140, 141 extend from the base 139 and comprise inward facing side surfaces 140 and outward facing side surfaces 141. In various embodiments, the sides 140, 141 may include flared ends 143 opposite the base 139. The flared ends 143 may comprise tie wire guide slots 144 operable to guide the metal tie wire 148 into position for tightening. The sides 140, 141 comprise tie wire holes 145 adjacent the base 139 such that the metal tie wire 148 extends through the tie wire hole 145 on one of the sides 140, 141, along the surface of the base 139 where the metal tie wire 148 may be secured by a bridge tab (not shown), and extends through the tie wire hole 145 in the other of the sides 140, 141. The opening 142 is defined between the inward facing side surfaces 140. The inward facing side surfaces 140 may comprise punch grips 147. The punch grips 147 are protrusions (e.g., dimples, indents, or the like) configured to engage a deformation pattern 112, 122 on the rebar guide 110 or rebar rod 120 to provide a strong and stable connection. The deformation pattern 112, 122 is protrusions (e.g., ribs or the like) on the rebar 110, 120, which may be a helical pattern, V-shaped pattern, swirls, or any suitable pattern. The second clamp portion 138 is configured to receive the rebar rod 120 (as shown in FIGS. 1-4) or rebar guide 110 in the opening 142 and against the base 139 and inward facing side surfaces 140 having the punch grips 147. The metal tie wire 148 may extend along the outward facing side surfaces 141 and through the tie wire guide slots 144 in the flared ends 143. The metal tie wire 148 provides a compressive force via the sides 140, 141 on the rebar rod 120 or guide 110 within the opening 142 when the metal tie wire 148 is tightened. In various embodiments, the metal tie wire 148 may comprise tie wire loops 149 at the ends to assist an operator in manipulating the metal tie wire 148 around the first 131 and second 138 clamp portions and to tighten the metal tie wire 148 by twisting, for example.

The back surface of the base 132, 139 of each of the first 131 and second 138 clamp portions are attached to or integrated with each other to form a single rebar cage connector 130. The first clamp portion 131 having the opening 135 formed by the base 132 and sides 133, 134 faces away from and is perpendicular to the second clamp portion 138 having the opening 142 formed by the base 139 and sides 140, 141. In this way and as shown in FIGS. 1-4, the first clamp portion 131 is configured to engage and secure a horizontal rebar guide 110 on a first side of the rebar cage connector 130 while the second clamp portion 138 is configured to simultaneously engage and secure a vertical rebar rod 120 on a second, opposite side of the rebar cage connector 130. The rebar cage connector 130 is shown in greater detail in FIGS. 5-8 as discussed below.

Figure 5:
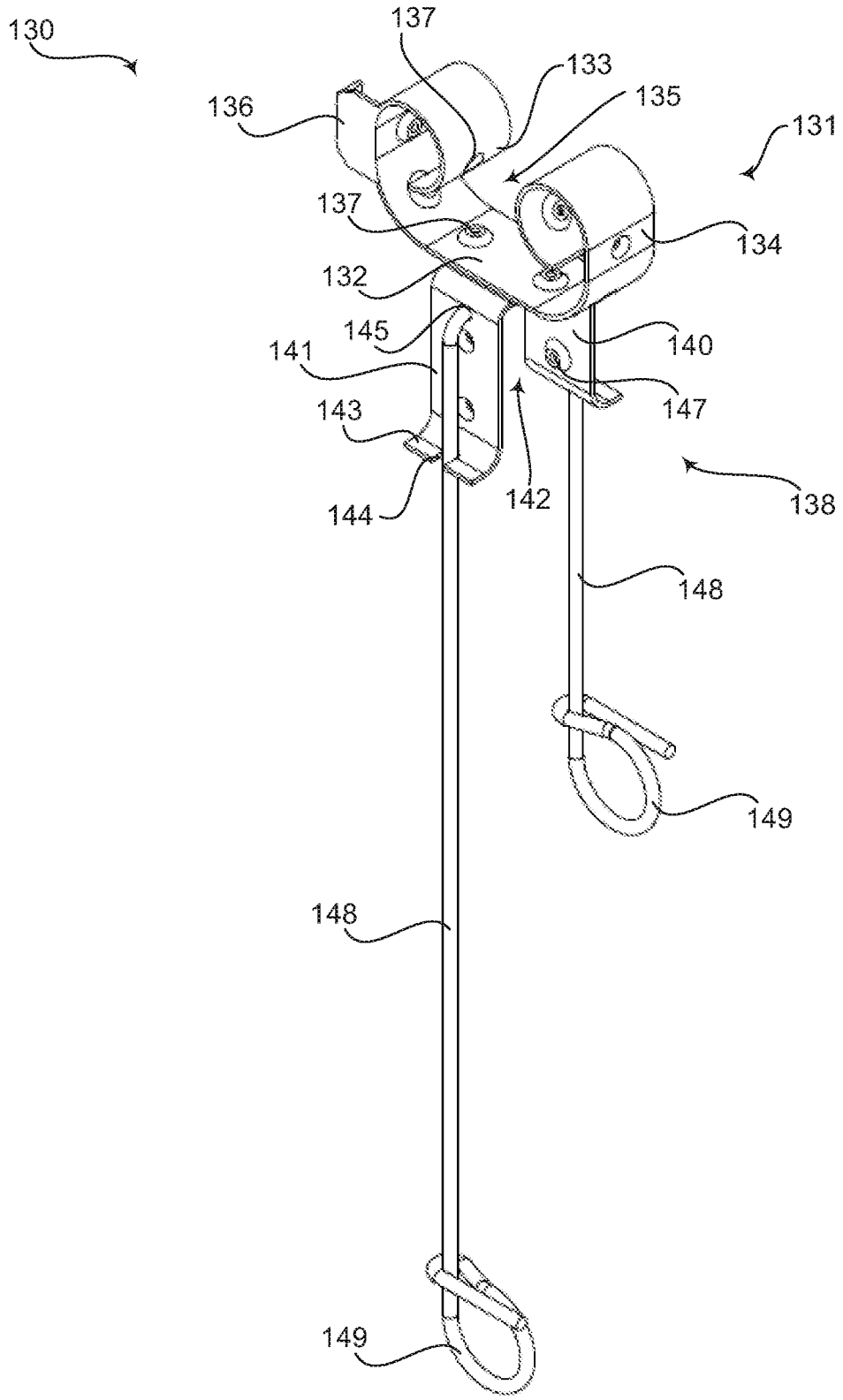
FIG. 5 depicts a rear, top perspective view of an exemplary reinforcing bar cage connector, in accordance with various embodiments.
Figure 6:
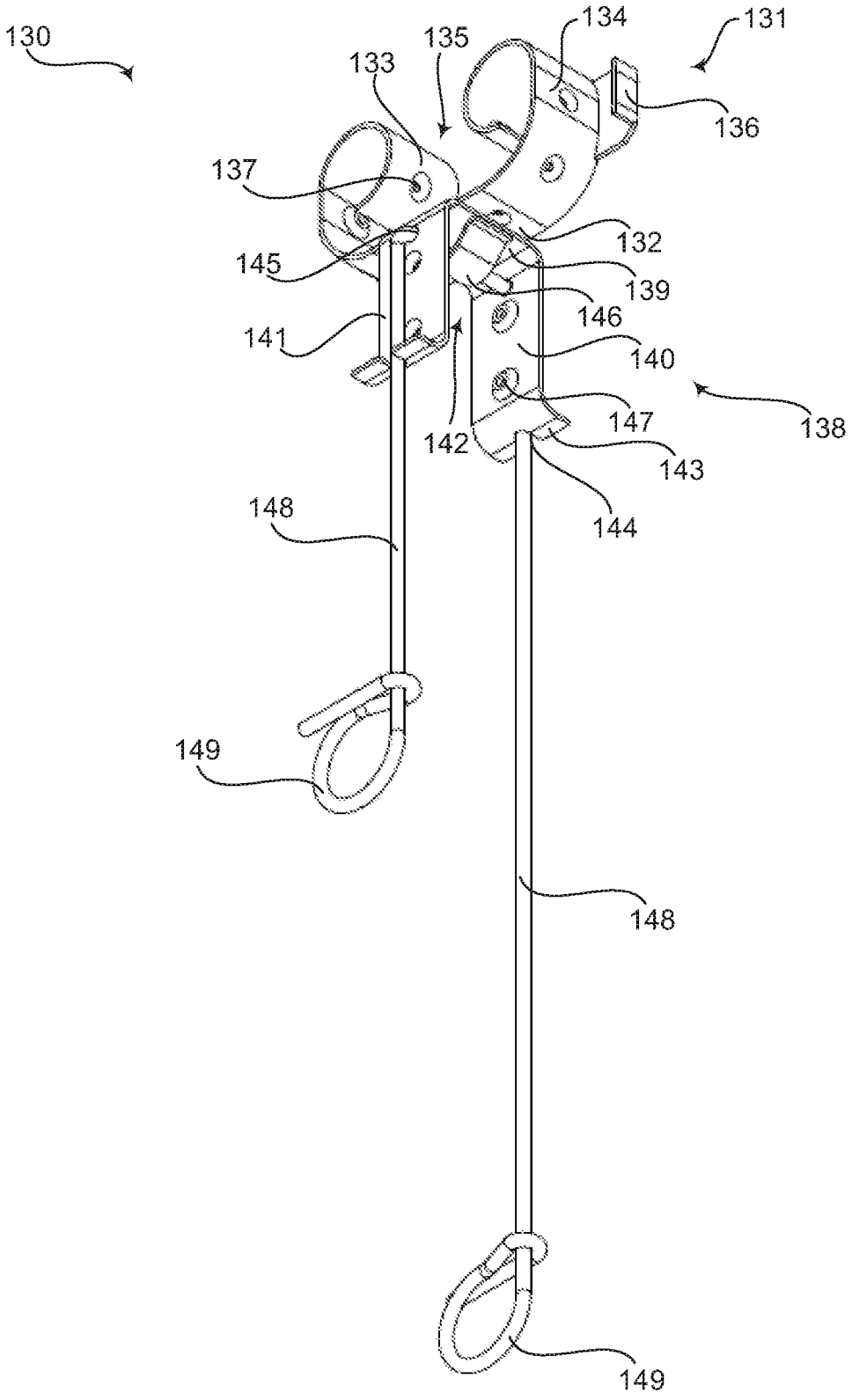
FIG. 6 depicts a front, bottom perspective view of an exemplary reinforcing bar cage connector, in accordance with various embodiments.
Figure 7:
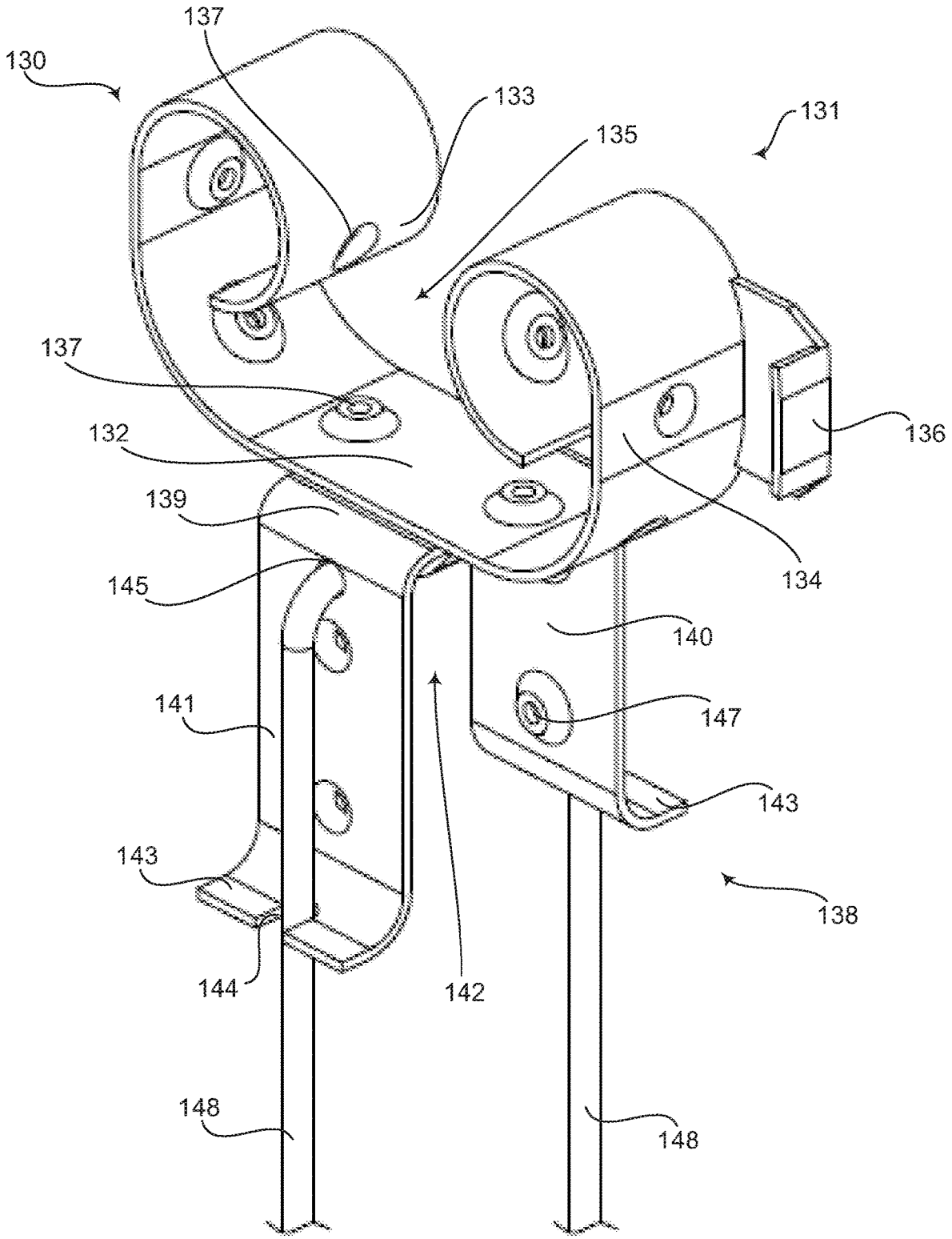
FIG. 7 depicts a front, top perspective view of exemplary first and second clamp portions of a reinforcing bar cage connector, in accordance with various embodiments.
Figure 8:
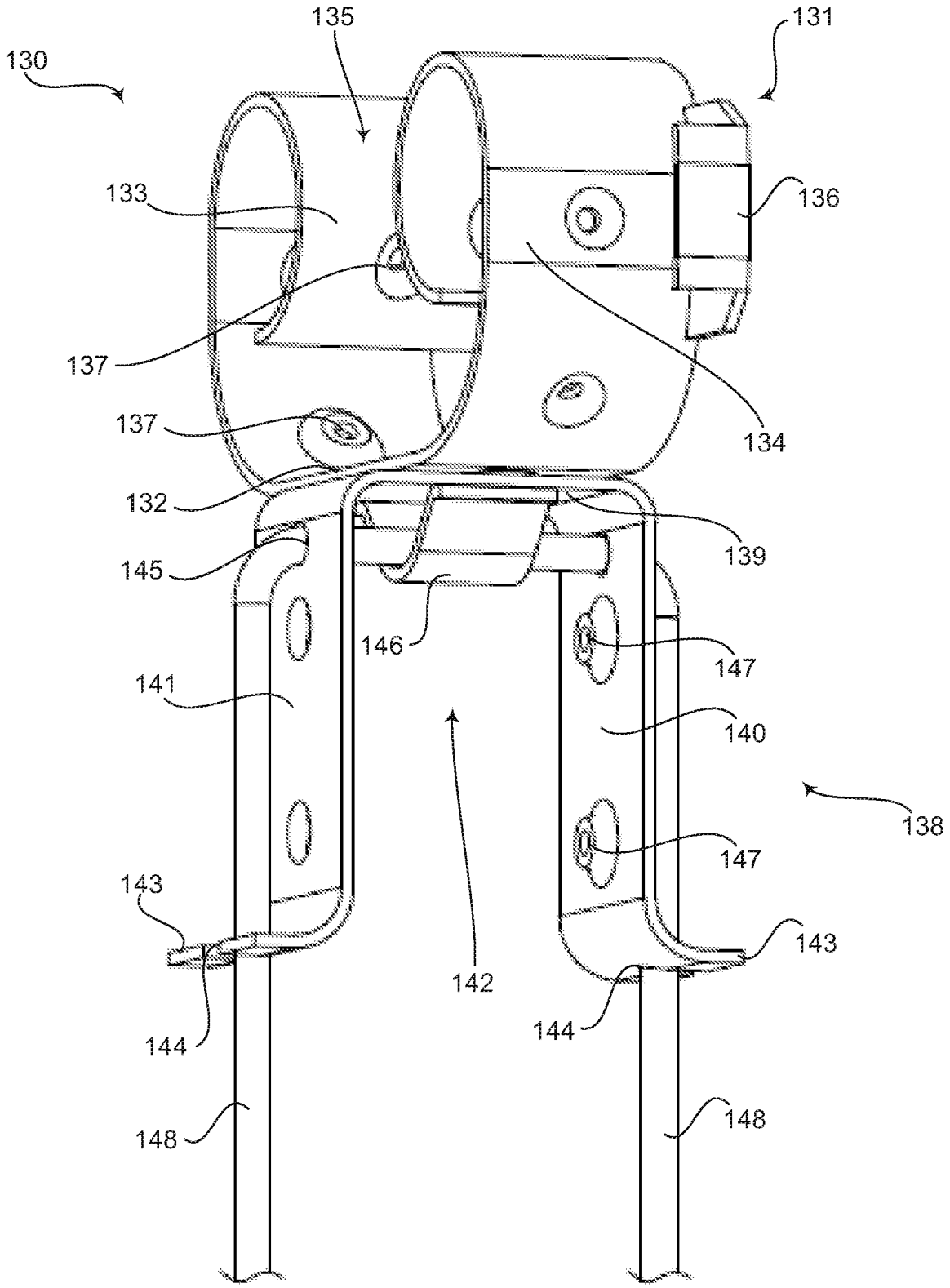
FIG. 8 depicts a side perspective view of exemplary first and second clamp portions of a reinforcing bar cage connector, in accordance with various embodiments.

FIG. 5 depicts a rear, top perspective view of an exemplary reinforcing bar cage connector 130, in accordance with various embodiments. FIG. 6 depicts a front, bottom perspective view of an exemplary reinforcing bar cage connector 130, in accordance with various embodiments. FIG. 7 depicts a front, top perspective view of exemplary first 131 and second 138 clamp portions of a reinforcing bar cage connector 130, in accordance with various embodiments. FIG. 8 depicts a side perspective view of exemplary first 131 and second 138 clamp portions of a reinforcing bar cage connector 130, in accordance with various embodiments.

Referring to FIGS. 5-8, a reinforcing bar cage connector 130 (i.e., rebar cage connector 130) is shown. The rebar cage connector 130 comprises a first clamp portion 131, a second clamp portion 138, and a metal tie wire 148. The first 131 and second 138 clamp portions are joined and/or integrated at a central portion with the openings 135, 142 facing away from (i.e., opposite) and perpendicular to each other. The first 131 and second 138 clamp portions may both be generally U-shaped. The ends of the first clamp portion 131 may curl or bend inwards to define inward facing surfaces 133 operable to engage received rebar. The ends 143 of the second clamp portion 138 may be flared outwards. Each of the first 131 and second 138 clamp portions comprise inward facing surfaces 133, 140 operable to engage received rebar, and outward facing surfaces 134, 141 configured to receive compressive force from the metal tie wire 148 when the metal tie wire is tightened. The inward facing surfaces 133, 140 of each of the first 131 and second 138 clamp portions define an opening 135, 142, each of the openings 135, 142 configured to receive rebar.

The base 132, 139 and/or inward facing surfaces 133, 140 of the first 131 and second 138 clamp portions may comprise punch grips 137, 147 operable to engage deformation patterns on received rebar. The punch grips 137, 147 hold onto the deformation pattern on the rebar, using its small, dimpled indentations to grasp the ribs or protrusions of the deformation pattern firmly. The punch grips 137, 147 are able to hold onto the deformation pattern with a strong and secure grip, helping to prevent the rebar from slipping or shifting within the clamps 131, 138. The dimpled indentations on the punch grips 137, 147 fit snugly around the ribs or protrusions of the deformation pattern, providing a secure and stable hold.

The outward facing surfaces 134, 141 of the first 131 and second 138 clamp portions may be configured to receive compressive forces by the metal tie wire 148 when the metal tie wire 148 is manipulated around the first 131 and second 138 clamp portions and tightened to secure rebar in the first 131 and second 138 clamp portions. The first clamp portion 131 may comprise an alignment guide 136 operable to guide the metal tie wire 148 along the outward facing surface 134 of the first clamp portion 131. The alignment guide 136 may be generally L-shaped and provided at a lateral edge of the outward facing surface 134 to prevent the tie wire 148 from sliding off of the outward facing surface 134 of the first clamp portion 131.

The second clamp portion 138 comprises tie wire guide slots 144, tie wire holes 145, and a bridge tab 146 operable to guide and securely hold the metal tie wire 148. The metal tie wire 148 extends through a tie wire hole 145 in each of the sides 140, 141 of the second clamp portion 138 adjacent the base 139 of the second clamp portion 138. The metal tie wire 148 extends across the base 139 and is securely held by the bridge tab 146, which holds the metal tie wire 148 against the base 139. Prior to use, a length of a first portion of the metal tie wire 148 extending from a first tie wire hole 145 on a first side 140, 141 of the second clamp portion 138 may be longer than a length of a second portion of the metal tie wire 148 extending from a second tie wire hole 145 on a second side 140, 141 of the second clamp portion 138. The shorter portion of the metal tie wire 148 extends across the outward facing side surface 141 on the second side and through the tie wire guide slot 144 at the flared end 143 of the second side. The longer portion of the metal tie wire 148 is manipulated against the alignment tab 136 of the first clamp portion 131, around the outward facing side surface 134 of the first clamp portion 131, back across the outward facing side surface 141 on the first side of the second clamp portion 138, and through the tie wire guide slot 144 at the flared end 143 of the first side of the second clamp portion 138 after the rebar has been received in the openings 135, 142 of the first 131 and second 138 clamp portions. The length of the initially longer portion of the metal tie wire 148 should be substantially a same length as the initially shorter portion of the metal tie wire 148 after the longer portion has been routed around the first clamp portion 131 and back through the tie wire guide slot 144 in the flared end 143 of the second clamp portion 138. The metal tie wire 148 may then be twisted to tighten the rebar cage connector 130 by providing compressive forces against the outward facing side surfaces 134, 141 of the first 131 and second 138 clamp portions.

The metal tie wire 148 may comprise metal tie wire loops 149 at the ends of the metal tie wire 148 to assist with manipulation of the metal tie wire 148. The metal tie wire 148 may be manipulated and tightened by hand or using metal tie wire tools, such as pliers, tie wire reels, rebar tie wire twisters, or any suitable tool.

Accordingly, the rebar cage connector 130 is a clamping device used for building a rebar cage 100, a structure used to reinforce concrete. The rebar cage connector 130 may be made of high carbon steel, or any suitable material, and coated with rust-resistant material to increase its durability and lifespan. The rebar cage connector 130 comprises two clamp portions 131, 138 that are joined together. Each clamp portion 131, 138 has punch grip 137, 147 features, which are dimpled or indented surfaces that are used to hold the rebar securely in place and provide a strong and stable connection.

Figure 9:
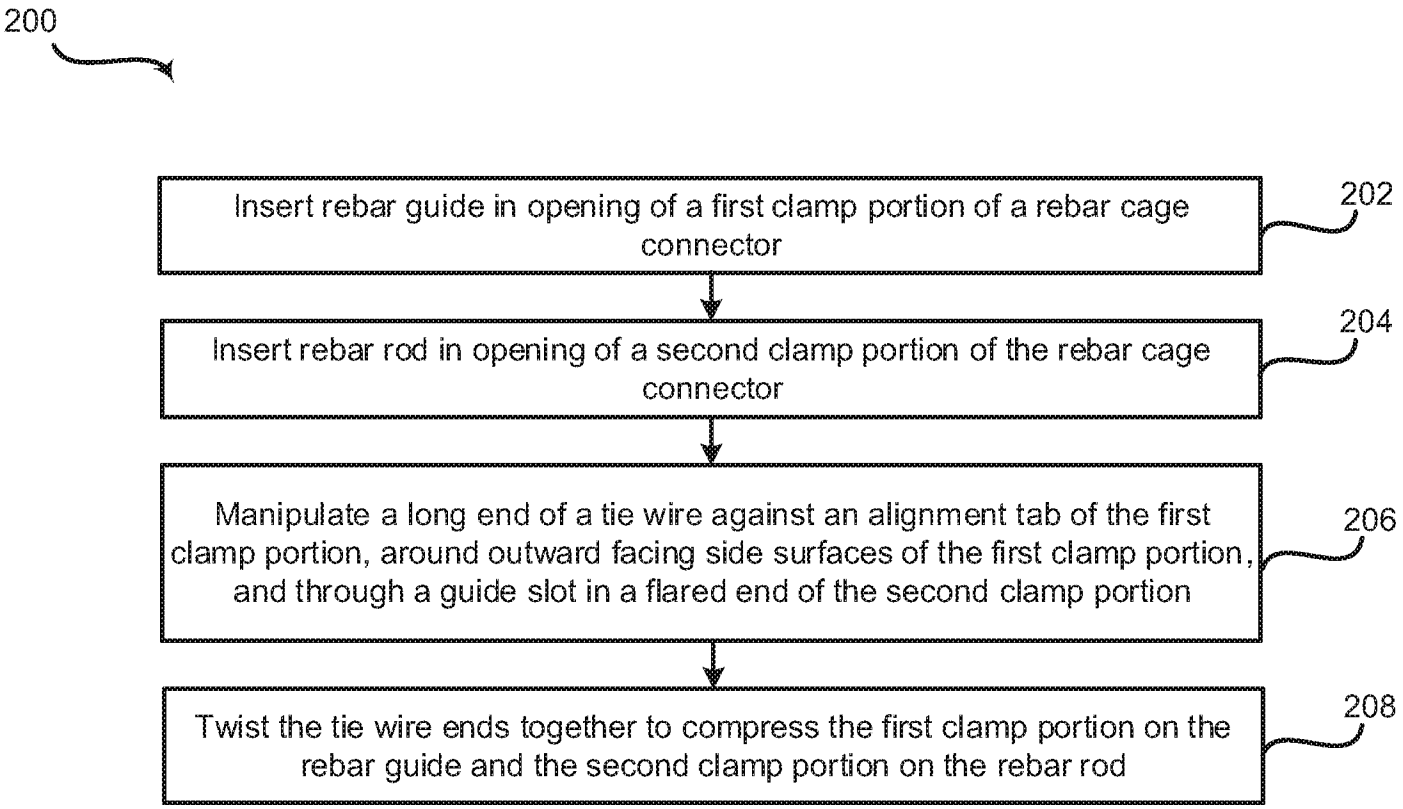
FIG. 9 is a flow chart illustrating exemplary steps that may be utilized for constructing reinforcing bar cages, in accordance with various embodiments.

FIG. 9 is a flow chart 200 illustrating exemplary steps 202-208 that may be utilized for constructing reinforcing bar cages 100, in accordance with various embodiments. Referring to FIG. 9, there is shown a flow chart 200 comprising exemplary steps 202 through 208. Certain embodiments may omit one or more of the steps, and/or perform the steps in a different order than the order listed, and/or combine certain of the steps discussed below. For example, some steps may not be performed in certain embodiments. As a further example, certain steps may be performed in a different temporal order, including simultaneously, than listed below.

At step 202, a rebar guide 110 is inserted in an opening 135 of a first clamp portion 131 of a rebar cage connector 130. At step 204, a rebar rod 120 is inserted in an opening 142 of a second clamp portion 138 of the rebar cage connector 130. At step 206, a long end of a metal tie wire 148 is manipulated against an alignment tab 136 of the first clamp portion 131, around outward facing side surfaces 134 of the first clamp portion 131, and through a guide slot 144 in a flared end 143 of the second clamp portion 138. At step 208, the ends of the metal tie wire 148 are twisted together to compress the first clamp portion 131 on the rebar guide 110 and the second clamp portion 138 on the rebar rod 120.

Steps 202 through 208 may be repeated using a rebar cage connector 130 for each connection point between the rebar guide(s) 110 and rebar rod(s) 120. For example, if the rebar cage 100 comprises three (3) rebar guides 110 and four (4) rebar rods 120, twelve (12) rebar cage connectors 130 may be implemented to build the rebar cage 100. Once a rebar cage 100 is constructed, it can be placed in a mold. The mold can then be filled with mixed concrete. After the concrete sets, the mold can be removed and a concrete element that contains a reinforcing guide can remain.

Aspects of the present disclosure provide reinforcing bar cage connectors 130 and methods 200 of constructing reinforcing bar cages 100. A reinforcing bar cage 100 may comprise a reinforcing bar guide 110, a reinforcing bar rod 120, and a reinforcing bar cage connector 130. The reinforcing bar cage connector 130 may comprise a first clamp portion 131 facing a first direction and configured to receive one of the reinforcing bar guide 110 or the reinforcing bar rod 120 in a first opening 135. The reinforcing bar cage connector 130 may comprise a second clamp portion 138 facing a second direction, opposite the first direction, and configured to receive an other one of the reinforcing bar guide 110 or the reinforcing bar rod 120 in a second opening 142. The first opening 135 is perpendicular to the second opening 142. The reinforcing bar cage connector 130 may comprise a metal tie wire 148 operable to be twisted to compress the first clamp portion 131 and the second clamp portion 138.

In an exemplary embodiment, the first clamp portion 131 of the reinforcing bar cage connector 130 comprises a first base 132 and first sides 133, 134 extending from the first base 132. The first sides 133, 134 comprise first inward facing side surfaces 133 and first outward facing side surfaces 134. The second clamp portion 138 of the reinforcing bar cage connector 130 comprises a second base 139 and second sides 140, 141 extending from the second base 139. The second sides 140, 141 comprise second inward facing side surfaces 140 and second outward facing side surfaces 141. In a representative embodiment, the first base 132 is integrated with or fixedly attached to the second base 139. In various embodiments, the first opening 135 is defined between the first inward facing side surfaces 133. The second opening 142 is defined between the second inward facing side surfaces 140. In certain embodiments, the first clamp portion 131 comprises an alignment tab 136 extending from a lateral edge of one of the first outward facing side surfaces 134. The alignment tab 136 is operable to guide the metal tie wire 148 along the first outward facing side surfaces 134. In an exemplary embodiment, the first sides 133, 134 extending from the first base 132 curl inwards to define the first inward facing side surfaces 133 of the first clamp portion 131. In a representative embodiment, ends 144 of the second sides 140, 141 are flared outward and comprise tie wire guide slots 144. The metal tie wire 148 extends through the tie wire guide slots 144. In various embodiments, the reinforcing bar guide 110 and/or the reinforcing bar rod 120 comprises a deformation pattern 112, 122. In certain embodiments, the first base 132, the first inward facing side surfaces 133, the second base 139, and/or the second inward facing side surfaces 140 comprise one or more punch grips 137, 147 configured to engage with the deformation pattern 112, 122. In an exemplary embodiment, each end of the metal tie wire 148 comprises a metal tie wire loop 149.

Various embodiments provide a reinforcing bar cage connector 130 comprising a first clamp portion 131, a second clamp portion 138, and a metal tie wire 148. The first clamp portion 131 faces a first direction and comprises a first base 132 and first sides 133, 134 extending from the first base 132. The first sides 133, 134 comprise first inward facing side surfaces 133 and first outward facing side surfaces 134. The second clamp portion 138 faces a second direction, opposite the first direction, and comprises a second base 139 and second sides 140, 141 extending from the second base 139. The second sides 140, 141 comprise second inward facing side surfaces 140 and second outward facing side surfaces 141. The first opening 135 is perpendicular to the second opening 142. The metal tie wire 148 is operable to be twisted to compress the first clamp portion 131 and the second clamp portion 138.

In a representative embodiment, the first base 132 is integrated with or fixedly attached to the second base 139. In various embodiments, the first opening 135 is defined between the first inward facing side surfaces 133 and the second opening 142 is defined between the second inward facing side surfaces 140. In certain embodiments, the first clamp portion 131 comprises an alignment tab 136 extending from a lateral edge of one of the first outward facing side surfaces 134. The alignment tab 136 is operable to guide the metal tie wire 148 along the first outward facing side surfaces 134. In an exemplary embodiment, the first sides 133, 134 extending from the first base 132 curl inwards to define the first inward facing side surfaces 133 of the first clamp portion 131. In a representative embodiment, ends 143 of the second sides 140, 141 are flared outward and comprise tie wire guide slots 144. The metal tie wire 148 extends through the tie wire guide slots 144. In various embodiments, the first base 132, the first inward facing side surfaces 133, the second base 139, and/or the second inward facing side surfaces 140 comprise one or more punch grips 137, 147 configured to engage with a deformation pattern 112, 122 on reinforcing bar 110, 120 received within the first opening 135 of the first clamp portion 131 and/or the second opening 142 of the second clamp portion 138. In certain embodiments, each end of the metal tie wire 148 comprises a metal tie wire loop 149. In an exemplary embodiment, the first clamp portion 131 and the second clamp portion 138 is made of high carbon steel and coated with rust-resistant material.

Certain embodiments provide a method 200 of constructing a reinforcing bar cage 100. The method 200 comprises inserting 202 a reinforcing bar guide 110 in a first opening 135 of a first clamp portion 131 of a reinforcing bar cage connector 130. The method 200 comprises inserting 204 a reinforcing bar rod 120 in a second opening 142 of a second clamp portion 138 of the reinforcing bar cage connector 130. The first opening 135 is perpendicular to the second opening 142. The first opening 135 and the second opening 142 face opposite directions. The method 200 comprises manipulating 206 a metal tie wire 148 around outward facing side surfaces 134 of the first clamp portion 131 and through a tie wire guide slot 144 in a flared end 143 of the second clamp portion 138. The method 200 comprises twisting 208 ends of the metal tie wire 148 together to compress the first clamp portion 131 on the reinforcing bar guide 110 and the second clamp portion 138 on the reinforcing bar rod 120.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a component is "operable" or "configured" to perform a function whenever the component comprises the necessary structure to perform the function, regardless of whether the function is performed.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed.

What is claimed is:

1. A reinforcing bar cage connector comprising:

a first clamp portion comprising:

a first base comprising first two opposite ends, a first front surface facing a first direction and extending between the first two opposite ends, and a first rear surface opposite the first front surface and extending between the first two opposite ends;

first sides extending in the first direction from the first two opposite ends of the first base, wherein the first sides comprise first inward facing side surfaces and first outward facing side surfaces; and a first opening formed by the first front surface of the first base and the first inward facing side surfaces of the first sides;

a second clamp portion comprising:

a second base comprising second two opposite ends, a second front surface, and a second rear surface opposite the second front surface, wherein the second front surface of the second base faces a second direction opposite the first direction, and wherein the second rear surface of the second base contacts the first rear surface of the first base;

second sides extending in the second direction from the second two opposite ends of the second base, wherein the second sides comprise second inward facing side surfaces and second outward facing side surfaces; and a second opening formed by the second front surface of the second base and the inward facing side surfaces of the first sides, wherein the first opening is perpendicular to the second opening, and a metal tie wire operable to be twisted to compress the first sides of the first clamp portion towards the first opening and the second sides of the second clamp portion towards the second opening.

2. The reinforcing bar cage connector of claim 1, wherein the first rear surface of the first base is fixedly attached to the second rear surface of the second base.

3. The reinforcing bar cage connector of claim 1, wherein the first clamp is oriented perpendicular to the second clamp.

4. The reinforcing bar cage connector of claim 1, wherein the first clamp portion comprises an alignment tab extending from a lateral edge of one of the first outward facing side surfaces, the alignment tab operable to guide the metal tie wire along the first outward facing side surfaces.

5. The reinforcing bar cage connector of claim 1, wherein the first sides extending from the first base curl inwards to define the first inward facing side surfaces of the first clamp portion.

6. The reinforcing bar cage connector of claim 1, wherein ends of the second sides are flared outward and comprise tie wire guide slots, the metal tie wire extending through the tie wire guide slots.

7. The reinforcing bar cage connector of claim 1, wherein:

one or both of the first base and the first inward facing side surfaces comprises a first at least one punch grip configured to engage with a first deformation pattern on a first reinforcing bar received within the first opening of the first clamp, and one or both of the second base and the second inward facing side surfaces comprises a second at least one punch grip configured to engage with a second deformation pattern on a second reinforcing bar received within the second opening of the second clamp portion.

8. The reinforcing bar cage connector of claim 1, wherein the metal tie wire comprises a first wire end and a second wire end, and wherein each of the first wire end and the second wire end comprises a metal tie wire loop.

9. The reinforcing bar cage connector of claim 1, wherein the first clamp portion and the second clamp portion are made of high carbon steel and coated with rust-resistant material.

10. A reinforcing bar cage comprising:

a reinforcing bar guide;

a reinforcing bar rod; and a reinforcing bar cage connector comprising:

a first clamp portion comprising:

a first base comprising first two opposite ends, a first front surface facing a first direction and extending between the first two opposite ends, and a first rear surface opposite the first front surface and extending between the first two opposite ends;

first sides extending in the first direction from the first two opposite ends of the first base, wherein the first sides comprise first inward facing side surfaces and first outward facing side surfaces; and a first opening formed by the first front surface of the first base and the first inward facing side surfaces of the first sides, wherein the first opening is configured to receive one of the reinforcing bar guide or the reinforcing bar rod;

a second clamp portion comprising:

a second base comprising second two opposite ends, a second front surface, and a second rear surface opposite the second front surface, wherein the second front surface of the second base faces a second direction opposite the first direction, and wherein the second rear surface of the second base contacts the first rear surface of the first base;

second sides extending in the second direction from the second two opposite ends of the second base, wherein the second sides comprise second inward facing side surfaces and second outward facing side surfaces; and a second opening formed by the second front surface of the second base and the inward facing side surfaces of the first sides, wherein the second opening is configured to receive an other one of the reinforcing bar guide or the reinforcing bar rod, and wherein the first opening is perpendicular to the second opening; and a metal tie wire operable to be twisted to compress the first sides of the first clamp portion towards the first opening and the second sides of the second clamp portion towards the second opening.

11. The reinforcing bar cage of claim 10, wherein the first clamp portion and the second clamp portion are made of high carbon steel and coated with rust-resistant material.

12. The reinforcing bar cage of claim 10, wherein the first rear surface of the first base is fixedly attached to the second rear surface of the second base.

13. The reinforcing bar cage of claim 10, wherein the first clamp is oriented perpendicular to the second clamp.

14. The reinforcing bar cage of claim 10, wherein the first clamp portion comprises an alignment tab extending from a lateral edge of one of the first outward facing side surfaces, the alignment tab operable to guide the metal tie wire along the first outward facing side surfaces.

15. The reinforcing bar cage of claim 10, wherein the first sides extending from the first base curl inwards to define the first inward facing side surfaces of the first clamp portion.

16. The reinforcing bar cage of claim 10, wherein ends of the second sides are flared outward and comprise tie wire guide slots, the metal tie wire extending through the tie wire guide slots.

17. The reinforcing bar cage of claim 10, wherein the reinforcing bar guide and the reinforcing bar rod comprises a deformation pattern.

18. The reinforcing bar cage of claim 17, wherein:

one or both of the first base and the first inward facing side surfaces comprises a first at least one punch grip configured to engage with the deformation pattern, and one or both of the second base and the second inward facing side surfaces comprises a second at least one punch grip configured to engage with the deformation pattern.

19. The reinforcing bar cage of claim 10, wherein the metal tie wire comprises a first wire end and a second wire end, and wherein each of the first wire end and the second wire end comprises a metal tie wire loop.

20. A method of constructing a reinforcing bar cage, the method comprising:

inserting a reinforcing bar guide in a first opening of a first clamp portion of a reinforcing bar cage connector, wherein the reinforcing bar cage connector comprises: the first clamp portion comprising:

a first base comprising first two opposite ends, a first front surface facing a first direction and extending between the first two opposite ends, and a first rear surface opposite the first front surface and extending between the first two opposite ends;

first sides extending in the first direction from the first two opposite ends of the first base, wherein the first sides comprise first inward facing side surfaces and first outward facing side surfaces; and the first opening formed by the first front surface of the first base and the first inward facing side surfaces of the first sides;

a second clamp portion comprising:

a second base comprising second two opposite ends, a second front surface, and a second rear surface opposite the second front surface, wherein the second front surface of the second base faces a second direction opposite the first direction, and wherein the second rear surface of the second base contacts the first rear surface of the first base;

second sides extending in the second direction from the second two opposite ends of the second base, wherein the second sides comprise second inward facing side surfaces and second outward facing side surfaces, and wherein a distal end of each of the second sides are flared outward and comprise a tie wire guide slot configured to receive a metal tie wire; and a second opening formed by the second front surface of the second base and the inward facing side surfaces of the first sides, and the metal tie wire operable to be twisted to compress the first sides of the first clamp portion towards the first opening and the second sides of the second clamp portion towards the second opening;

inserting a reinforcing bar rod in the second opening of the second clamp portion of the reinforcing bar cage connector, wherein the first opening is perpendicular to the second opening;

manipulating the metal tie wire around the first outward facing side surfaces of the first clamp portion and through the tie wire guide slot in the distal end of each of the second sides of the second clamp portion; and twisting ends of the metal tie wire together to compress the first sides of the first clamp portion on the reinforcing bar guide and the second sides of the second clamp portion on the reinforcing bar rod.

* * * * *